US009046812B2

(12) United States Patent
Yamane et al.

(10) Patent No.: US 9,046,812 B2
(45) Date of Patent: Jun. 2, 2015

(54) DEVELOPMENT DEVICE AND IMAGE FORMING APPARATUS INCLUDING THE SAME

(71) Applicant: KYOCERA DOCUMENT SOLUTIONS INC., Osaka (JP)

(72) Inventors: Naoki Yamane, Osaka (JP); Takeshi Fujimura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 19 days.

(21) Appl. No.: 14/075,682

(22) Filed: Nov. 8, 2013

(65) Prior Publication Data

US 2014/0140740 A1 May 22, 2014

(30) Foreign Application Priority Data

Nov. 19, 2012 (JP) ..... 2012-253476

(51) Int. Cl.
*G03G 15/09* (2006.01)
*G03G 15/08* (2006.01)

(52) U.S. Cl.
CPC ..... *G03G 15/0806* (2013.01); *G03G 15/0808* (2013.01); *G03G 2215/0132* (2013.01)

(58) Field of Classification Search
USPC ..... 399/274, 284
See application file for complete search history.

(56) References Cited

U.S. PATENT DOCUMENTS

| | | | | |
|---|---|---|---|---|
| 5,396,319 | A * | 3/1995 | Tokuhashi et al. | |
| 2011/0229184 | A1* | 9/2011 | Kashimoto et al. | |
| 2012/0201575 | A1* | 8/2012 | Kashimoto et al. | |
| 2013/0209142 | A1* | 8/2013 | Kusukawa et al. | 399/274 |

FOREIGN PATENT DOCUMENTS

| | | | |
|---|---|---|---|
| JP | 06-069961 | A | 9/1994 |
| JP | 09-211974 | A | 8/1997 |
| JP | 2011-197285 | A | 10/2011 |

* cited by examiner

*Primary Examiner* — Walter L Lindsay, Jr.
*Assistant Examiner* — Milton Gonzalez
(74) *Attorney, Agent, or Firm* — Studebaker & Brackett PC

(57) ABSTRACT

A film member in a development device can vibrate with respect to an internal wall in the development device. An idler gear in the development device includes a projection and is reciprocally movable between a first position and a second position. The first position is a position where the projection is apart from an end edge of the film member in response to a rotation of a toner supply roller when image formation is performed. The second position is a position where the projection overlaps with the end edge of the film member in response to a reverse rotation of the toner supply roller when image formation is not performed. The projection causes the film member to vibrate by intermittently coming into contact with the end edge of the film member along with a rotation of the idler gear at the second position.

17 Claims, 11 Drawing Sheets

DEVELOPMENT DEVICE AND IMAGE FORMING APPARATUS INCLUDING THE SAME

INCORPORATION BY REFERENCE

The present application claims priority under 35 U.S.C. §119 to Japanese Patent Application No. 2012-253476, filed Nov. 19, 2012. The contents of this application are incorporated herein by reference in their entirety.

BACKGROUND

The present disclosure relates to development devices that supply toner to an image carrier and electrophotographic image forming apparatuses including the development device.

An electrophotographic image forming apparatus forms an electrostatic latent image by irradiating a circumferential surface of an image carrier (photosensitive drum) with light based on image information read from an original image or image information obtained, by transmission and so on, from an outer device such as a computer. The image forming apparatus supplies toner from the development device to the electrostatic latent image and forms a toner image, and then transfers the toner image onto paper. After the transfer processing, fusing processing is performed on the toner image, and then the paper is ejected externally.

The following describes a development method using a dry toner in an image forming apparatus using an electrophotographic process. For the development method, a two component developer is used. The two component developer includes a magnetic carrier and toner. A magnetic roller (toner supply roller) and a development roller are used. The magnetic roller carries the developer. The development roller only carries toner. In transitioning the toner onto the development roller using the magnetic roller, a toner thin layer is formed by transitioning only non-magnetic toner onto the development roller, with the magnetic carrier remaining on the magnetic roller. The development roller is disposed so as not to have contact with the photosensitive drum. In an opposite area (development area) where the development roller and the photosensitive drum are opposing each other, the toner is attached to the electrostatic latent image on the photosensitive drum by alternating electric field.

In recent years, in the image forming apparatus, an apparatus configuration has become more complicated along with progress in color printing and high-speed processing. In addition, to respond to high-speed processing, high rotation of a toner stirring member within the development device is required. Especially, according to the development method as described above, in an opposite area where the development roller and the magnetic roller are opposing each other, a magnetic brush formed on the magnetic roller causes only the toner to be carried by the development roller. Furthermore, the toner that has not been used for the development is taken off the development roller. This is likely to cause the toner to float in the vicinity of the opposite area where the development roller and the magnetic roller are opposing each other. In some cases, such floating toner accumulates in a periphery of an ear-cutting blade (restricting blade). The accumulated toner, which clumps tighter and adheres to the development roller, is likely to cause an image defect due to toner drop.

To solve such problems, a certain image forming apparatus includes a wall. The wall is provided between the restricting blade and the development area, and is opposing the development roller. In the wall, a flexible sheet member and an elliptical roller are provided. The sheet member forms a part of an internal surface of the wall and is also capable of swinging in a direction perpendicular to the internal surface of the wall. The elliptical roller swings the sheet member.

In addition, a certain development device includes an excitation mechanism. The excitation mechanism provides acceleration to the toner. The direction of the acceleration is a direction in which the toner adhering to a wall of the development device is shaken off into the case.

Furthermore, a certain image forming apparatus oscillates a drive motor itself. The drive motor drives a flow means. The flow means causes the toner in the toner case to flow. The development device prevents toner from remaining on the internal surface of the wall in the toner case by transmitting the oscillation of the drive motor to the toner case.

SUMMARY

According to a first aspect of the present disclosure, a development device includes a development roller, a toner supply roller, a restricting blade, and a casing. The development roller is disposed opposite to an image carrier on which an electrostatic latent image is formed, and supplies toner to the image carrier in an area opposing the image carrier. The toner supply roller is disposed opposite to the development roller and supplies toner to the development roller in an area opposing the development roller. The restricting blade is disposed opposite to the toner supply roller at a first predetermined distance. The casing houses the development roller, the toner supply roller, and the restricting blade.

The casing includes an internal wall. The internal wall is opposing the development roller between the restricting blade and the image carrier. The development device includes a film member having flexibility, a biasing member, and an idler gear. The film member is disposed at a second predetermined distance from a top surface of the internal wall and is capable of vibrating in a direction in which the film member moves closer to or apart from the internal wall. The biasing member is connected to at least one end in a longitudinal direction of the film member and provides tension to the film member. The idler gear is a helical gear.

The idler gear includes at least one projection. The idler gear is reciprocally movable between a first position and a second position along a rotational axis of the idler gear. The first position is a position where the projection is apart from an end edge of the film member in response to a rotation of the toner supply roller when image formation is performed. The second position is a position where the projection overlaps with the end edge of the film member in response to a reverse rotation of the toner supply roller when image formation is not performed. The projection causes the film member to vibrate by intermittently coming into contact with the end edge of the film member along with the rotation of the idler gear positioned at the second position.

According to a second aspect of the present disclosure, an image forming apparatus includes the development device according to the first aspect of the present disclosure.

DETAILED DESCRIPTION

The following describes embodiments according to the present disclosure with reference to the drawings.

First Embodiment

Figure 1:
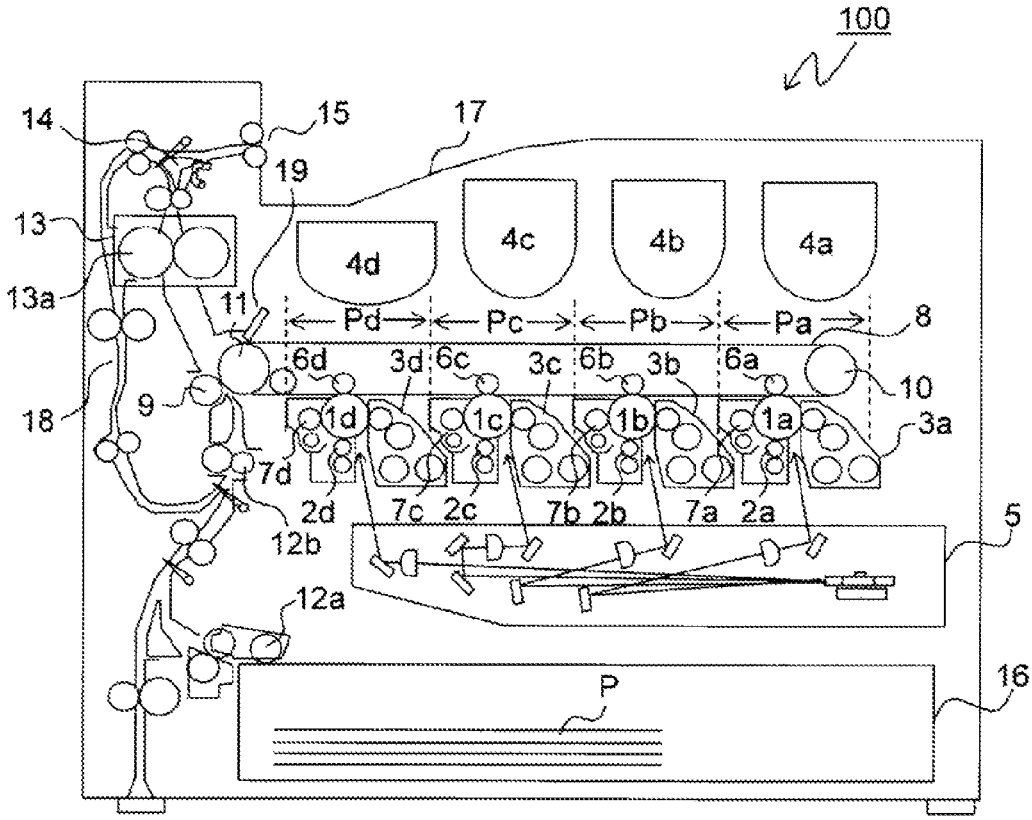
FIG. 1 is a schematic configuration diagram of an image forming apparatus 100 that includes development devices from a development device 3*a* to a development device 3*d* according to the present disclosure.

FIG. 1 is a schematic cross-sectional view of an image forming apparatus 100 in which a development device 3*a*, a development device 3*b*, a development device 3*c*, and a development device 3*d* according to a first embodiment of the present disclosure are incorporated. The image forming apparatus 100 shown in FIG. 1 is a color image forming apparatus of a tandem system. The following describes a color printer as an example of the image forming apparatus 100.

A main body of the color printer 100 includes four image forming sections: an image forming section Pa, an image forming section Pb, an image forming section Pc, and an image forming section Pd that are provided in order, from upstream in a rotational direction of an intermediate transfer belt 8 (the right side in FIG. 1). The image forming sections Pa to Pd are provided corresponding to images in four different colors (cyan, magenta, yellow, and black). The image forming section Pa, the image forming section Pb, the image forming section Pc, and the image forming section Pd sequentially form an image in cyan, an image in magenta, an image in yellow, and an image in black, respectively, according to each procedure of charging, exposure, development, and transfer.

The image forming section Pa, the image forming section Pb, the image forming section Pc, and the image forming section Pd include, respectively, a photosensitive drum 1*a*, a photosensitive drum 1*b*, a photosensitive drum 1*c*, and a photosensitive drum 1*d*. Each of the photosensitive drums 1*a* to 1*d* functions as an image carrier. The photosensitive drum 1*a*, the photosensitive drum 1*b*, the photosensitive drum 1*c*, and the photosensitive drum 1*d* carry, respectively, a visible image (toner image) in cyan, a visible image (toner image) in magenta, a visible image (toner image) in yellow, and a visible image (toner image) in black. In addition, the intermediate transfer belt 8 is provided adjacent to the image forming sections Pa to Pd. The intermediate transfer belt 8 is caused to rotate in a clockwise direction in FIG. 1 by a drive means (not shown).

The toner image formed on each of the photosensitive drums 1*a* to 1*d* is sequentially primary transferred and superimposed onto the intermediate transfer belt 8 that moves in contact with a corresponding one of the photosensitive drums 1*a* to 1*d*. Subsequently, the toner image that is primary transferred onto the intermediate transfer belt 8 is secondary transferred, by an action of a secondary transfer roller 9, onto transfer paper P as an example of a recording medium. Furthermore, after the toner image is fused in a fusing section 13, the transfer paper P on which the toner image is secondary transferred is ejected from the main body of the color printer 100. The image forming process is performed on each of the photosensitive drums 1*a* to 1*d* in FIG. 1, with each of the photosensitive drums 1*a* to 1*d* being rotated in an anticlockwise direction.

The transfer paper P on which the toner image is secondary transferred is stored in a paper cassette 16. The paper cassette 16 is disposed in a lower part of the main body of the color printer 100. The transfer paper P is carried to a nip section via a paper feed roller 12*a* and a pair of resist rollers 12*b*. The nip section includes the secondary transfer roller 9 and a drive roller 11 for the intermediate transfer belt 8 that is to be described later. For the intermediate transfer belt 8, a dielectric resin sheet is used. In addition, for the intermediate transfer belt 8, a seam-free (seamless) belt is mainly used. In addition, a belt cleaner 19 is disposed more downstream in a conveyance direction than the secondary transfer roller 9. The belt cleaner 19 has a blade shape and removes the residual toner and so on from the surface of the intermediate transfer belt 8.

Next, the image forming sections Pa to Pd will be described. Each of the photosensitive drums 1*a* to 1*d* is rotatably provided. Around the photosensitive drum 1*a*, a charger 2*a*, the development device 3*a*, and a cleaning section 7*a* are provided. Around the photosensitive drum 1*b*, a charger 2*b*, the development device 3*b*, and a cleaning section 7*b* are provided. Around the photosensitive drum 1*c*, a charger 2*c*, the development device 3*c*, and a cleaning section 7*c* are provided. Around the photosensitive drum 1*d*, a charger 2*d*, the development device 3*d*, and a cleaning section 7*d* are provided.

The charger 2*a*, the charger 2*b*, the charger 2*c*, and the charger 2*d* charge, respectively, the photosensitive drum 1*a*, the photosensitive drum 1*b*, the photosensitive drum 1*c*, and the photosensitive drum 1*d*. The development device 3*a*, the development device 3*b*, the development device 3*c*, and the development device 3*d* form, respectively, toner images on the photosensitive drum 1*a*, the photosensitive drum 1*b*, the photosensitive drum 1*c*, and the photosensitive drum 1*d*. The cleaning section 7*a*, the cleaning section 7*b*, the cleaning section 7*c*, and the cleaning section 7*d* remove, respectively, the residual toner and so on from the photosensitive drum 1*a*, the photosensitive drum 1*b*, the photosensitive drum 1*c*, and the photosensitive drum 1*d*.

Below the photosensitive drums 1*a* to 1*d*, an exposure device 5 is provided. The exposure device 5 exposes image information on each of the photosensitive drums 1*a* to 1*d*.

When the image data is entered from a higher-level device such as a PC and so on, first, the chargers 2*a* to 2*d* uniformly charge, respectively, surfaces of the photosensitive drums 1*a* to 1*d*. Next, the exposure device 5 irradiates each of the photosensitive drums 1*a* to 1*d* with light according to the image data, thereby forming an electrostatic latent image according to the image data on each of the photosensitive drums 1*a* to 1*d*. Each of the development devices 3*a* to 3*d* is filled with a two component developer. The two component developer includes toner and a carrier. In other words, the development device 3*a* is filled with a predetermined amount of two component developer including cyan toner. The development device 3*b* is filled with a predetermined amount of two component developer including magenta toner. The development device 3*c* is filled with a predetermined amount of two component developer including yellow toner. The development device 3*d* is filled with a predetermined amount of two component developer including black toner. The carrier included in the two component developer is, for example, a magnetic carrier.

It should be noted that when the percentage of toner in the two component developer filled in the development device 3*a* is below a given value as a result of forming the toner image as described below, cyan toner is supplied from the toner container (supply means) 4*a* to the development device 3*a*. When the percentage of toner in the two component developer filled in the development device 3*b* is below a given value as a result of forming the toner image, magenta toner is supplied from the toner container (supply means) 4*b* to the development device 3*b*. When the percentage of toner in the two component developer filled in the development device 3*c* is below a given value as a result of forming the toner image, yellow toner is supplied from the toner container (supply means) 4*c* to the development device 3*c*. When the percentage of toner in the two component developer filled in the development device 3*d* is below a given value as a result of forming the toner image, black toner is supplied from the toner container (supply means) 4*d* to the development device 3*d*.

The toner included in the developer is supplied onto the photosensitive drums 1*a* to 1*d* by the development devices 3*a* to 3*d*, and is electrostatically attached to the photosensitive drums 1*a* to 1*d*. As a result, on each of the photosensitive drums 1*a* to 1*d*, a toner image is formed according to the electrostatic latent image formed by the exposure from the exposure device 5.

Then, a primary transfer roller 6*a* provides an electric field at a predetermined transfer voltage, between the primary transfer roller 6*a* and the photosensitive drum 1*a*. As a result, the toner image in cyan on the photosensitive drum 1*a* is primary transferred onto the intermediate transfer belt 8. A primary transfer roller 6*b* provides an electric field at a predetermined transfer voltage, between the primary transfer roller 6*b* and the photosensitive drum 1*b*. As a result, the toner image in magenta on the photosensitive drum 1*b* is primary transferred onto the intermediate transfer belt 8. A primary transfer roller 6*c* provides an electric field at a predetermined transfer voltage, between the primary transfer roller 6*c* and the photosensitive drum 1*c*. As a result, the toner image in yellow on the photosensitive drum 1*c* is primary transferred onto the intermediate transfer belt 8. A primary transfer roller 6*d* provides an electric field at a predetermined transfer voltage, between the primary transfer roller 6*d* and the photosensitive drum 1*d*. As a result, the toner image in black on the photosensitive drum 1*d* is primary transferred onto the intermediate transfer belt 8.

These images in the four colors are formed with a predetermined positional relationship that is previously designated for forming a predetermined full-color image. Subsequently, in preparation for subsequent forming of another electrostatic latent image, the residual toner and so on, which remain on the surfaces of the photosensitive drums 1*a* to 1*d* after the primary transfer, are removed by the cleaning sections 7*a* to 7*d* after the primary transfer.

The intermediate transfer belt 8 is wound around both a driven roller 10 provided upstream in the rotational direction and the drive roller 11 provided downstream in the rotational direction. The intermediate transfer belt 8 starts rotating in a clockwise direction along with a rotation of the drive roller 11 caused by a drive motor (not shown). When the intermediate transfer belt 8 starts rotating, the transfer paper P is carried to a nip section (secondary transfer nip section) from the pair of resist rollers 12*b* with predetermined timing. The nip section includes the drive roller 11 and the secondary transfer roller 9 provided adjacent to the drive roller 11. In the nip section, the toner image (full-color image) on the intermediate transfer belt 8 is secondary transferred onto the transfer paper P. The transfer paper P on which the toner image is secondary transferred is carried to the fusing section 13.

The transfer paper P carried to the fusing section 13 is provided with heat and pressure by a pair of fusing rollers 13*a*. As a result, the toner image is fused onto the surface of the transfer paper P, so that the predetermined full-color image is formed. A branching section 14 sets the conveyance direction for carrying the transfer paper P on which the full-color image has been formed, to one of a plurality of conveyance directions. In other words, the branching section 14 allocates the transfer paper P into a conveyance path along one of the conveyance directions. In the case of forming an image only on one side of the transfer paper P, the transfer paper P is directly ejected into an exit tray 17 by an exit roller 15.

On the other hand, in the case of forming an image on both sides of the transfer paper P, the transfer paper P, which has passed through the fusing section 13, is once carried to the exit roller 15. Then, after a rear end of the transfer paper P passes through the branching section 14, the exit roller 15 is caused to reversely rotate, along with switching the conveyance direction by the branching section 14. With this, the transfer paper P is allocated, starting from the rear end, into a paper conveyance path 18, and is carried again to the secondary transfer nip section with the surface on which the image is formed being reversed. Then, the next toner image formed on the intermediate transfer belt 8 is secondary transferred, by the secondary transfer roller 9, onto a surface, on which the image is not formed, of the transfer paper P. The transfer paper P on which the toner image is secondary transferred is carried to the fusing section 13 to have the toner image fused thereon, and is subsequently ejected into the exit tray 17.

Figure 2:
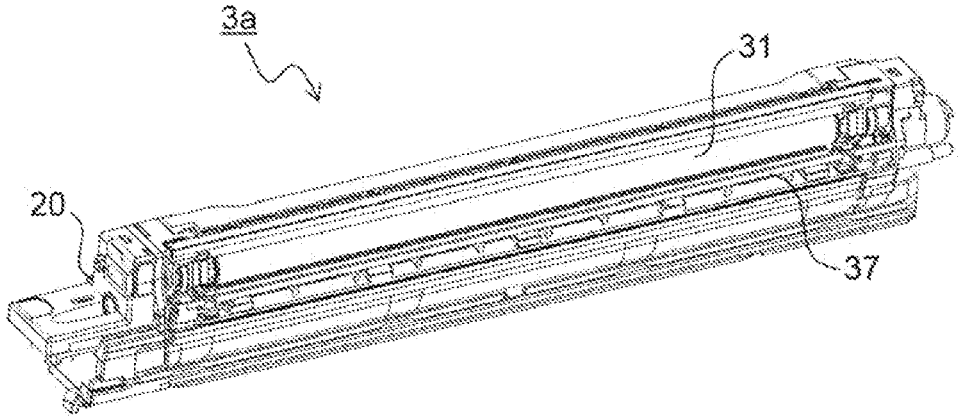
FIG. 2 is a perspective view of the development device 3*a* according to a first embodiment of the present disclosure.
Figure 3:
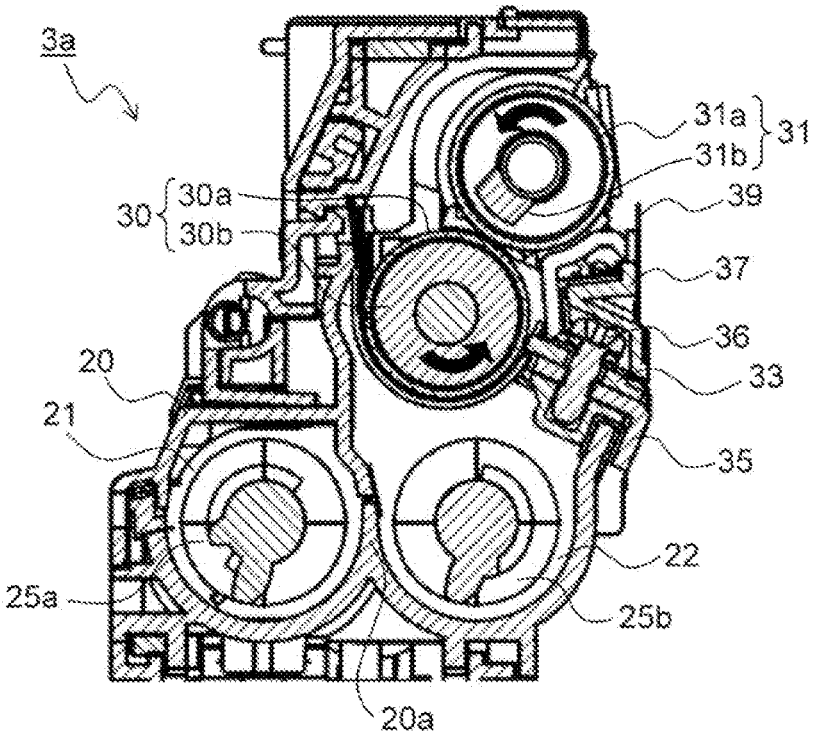
FIG. 3 is a side cross-sectional view of the development device 3*a* according to the first embodiment of the present disclosure.

FIG. 2 is an external perspective view of the development device 3*a* according to the first embodiment of the present disclosure. FIG. 3 is a schematic side cross-sectional view of the development device 3*a* according to the first embodiment. It should be noted that FIG. 3 shows a state of the development device 3*a* as viewed from a back side in FIG. 1. Therefore, when compared, the position of each member in the development device 3*a* as shown in FIG. 3 and the position of each member in the development device 3*a* as shown in FIG. 1 are left-right reversal. In addition, the following description illustrates the development device 3*a* provided in the image forming section Pa in FIG. 1, but the development devices 3*b* to 3*d* provided in the image forming sections Pb to Pd have basically the same configuration as the development device 3*a*, and therefore the descriptions thereof are omitted. In addition, in the description hereafter, a front side of the main body of the color printer 100 is referred to as a front side, and a back side of the main body of the color printer 100 is referred to as a rear side. For example, in FIG. 2, a right end of the development device 3*a* is the front side, and a left end is the rear side.

As shown in FIG. 2 and FIG. 3, the development device 3*a* includes a developer container 20 in which the two component developer (hereinafter, also simply referred to as the developer) is stored. The developer container 20 functions as a casing. The developer container 20 houses a development roller 31, a toner supply roller 30, the ear-cutting blade 33, a stir conveyance screw 25*a*, and a supply conveyance screw 25*b*. The ear-cutting blade 33 functions as a restricting blade.

The developer container 20 is partitioned, by a partition wall 20*a*, into a stir conveyance chamber 21 and a supply conveyance chamber 22. In the stir conveyance chamber 21, the stir conveyance screw 25*a* is rotatably provided. In the supply conveyance chamber 22, the supply conveyance screw 25*b* is rotatably provided. Each of the stir conveyance screw 25*a* and the supply conveyance screw 25*b* mixes the toner (positively-charged toner) supplied from the toner container 4*a* (see FIG. 1) with the carrier and stirs the mixture, thereby charging the mixture.

Then, the developer (toner and carrier), while being stirred by the stir conveyance screw 25*a* and the supply conveyance screw 25*b*, is carried in an axis direction (a direction perpendicular to the plane of paper in FIG. 3). Then, the developer circulates between the stir conveyance chamber 21 and the supply conveyance chamber 22 via a developer passage, not shown, formed at both ends of the partition wall 20*a*. In other words, a circulation pathway for the developer is formed in the developer container 20, by the stir conveyance chamber 21, the supply conveyance chamber 22, and the developer passage.

The developer container 20 is extended diagonally upward right in FIG. 3. In the developer container 20, the toner supply roller 30 is disposed above the supply conveyance screw 25*b*. The development roller 31 is disposed opposite to the toner supply roller 30, in the diagonally upward right of the toner supply roller 30. Then, the development roller 31 is disposed opposite to the photosensitive drum 1*a* (see FIG. 1), at an opening side of the developer container 20 (the right side in FIG. 3). Each of the toner supply roller 30 and the development roller 31 rotates around the rotational axis in an anticlockwise direction in FIG. 3.

In the stir conveyance chamber 21, a toner density sensor, not shown, is disposed opposite to the stir conveyance screw 25*a*. Based on a result of the detection by the toner density sensor, toner is supplied from the toner container 4*a* to the stir conveyance chamber 21 via a toner supply port that is not shown. For the toner density sensor, for example, a magnetic permeability sensor is used. The magnetic permeability sensor detects magnetic permeability of the two component developer, which includes the toner and the magnetic carrier, in the developer container 20.

The toner supply roller 30 is a magnetic roller. The toner supply roller 30 includes a rotational sleeve 30*a* that is non-magnetic, and a fixed magnetic member 30*b*. The rotational sleeve 30*a* rotates in an anticlockwise direction in FIG. 3. The fixed magnetic member 30*b* is included in the rotational sleeve 30*a* and has a plurality of magnetic poles (corresponding to a plurality of magnetic poles 29 in FIG. 13). In other words, the toner supply roller 30 is a magnetic roller that carries the two component developer by the plurality of magnetic poles provided inside the toner supply roller 30.

The development roller 31 includes the development sleeve 31*a* having a cylindrical shape and a development-roller-side magnetic pole 31*b*. The development sleeve 31*a* rotates in an anticlockwise direction in FIG. 3. The development-roller-side magnetic pole 31*b* is fixed inside the development sleeve 31*a*. The toner supply roller 30 and the development roller 31 are opposing each other at a predetermined gap at a facing position (opposing position) thereof. The development-roller-side magnetic pole 31*b* has a reverse polarity to an opposing magnetic pole (main pole) in the fixed magnetic member 30*b*.

In addition, to the developer container 20, the ear-cutting blade 33 is attached in a longitudinal direction of the toner supply roller 30 (a direction perpendicular to the plane of paper in FIG. 3). The ear-cutting blade 33 is fixed by fastening with blade fixing screws 36, to a blade support stay 35 mounted to the developer container 20. The ear-cutting blade 33 is disposed, in the rotational direction (anticlockwise direction in FIG. 3) of the toner supply roller 30, more upstream than the position at which the development roller 31 and the toner supply roller 30 are opposing each other. Then, there is a slight gap between a tip of the ear-cutting blade 33 and a surface of the toner supply roller 30. In other words, the ear-cutting blade 33 is disposed opposite to the toner supply roller 30 at a predetermined distance (first predetermined distance).

To the development roller 31, a direct current voltage (hereinafter, referred to as Vslv(DC)) and an alternating current voltage (hereinafter, referred to as Vslv(AC)) are applied. To the toner supply roller 30, a direct current voltage (hereinafter, referred to as Vmag(DC)) and an alternating current voltage (hereinafter, referred to as Vmag(AC)) are applied. These direct current voltages and alternating current voltages are applied to the development roller 31 and the toner supply roller 30, from a development bias power via a bias control circuit (neither is shown).

As described earlier, the toner included in the developer is charged by circulating the developer, which is concurrently stirred by the stir conveyance screw 25*a* and the supply conveyance screw 25*b*, within the stir conveyance chamber 21 and the supply conveyance chamber 22 in the developer container 20. The developer in the supply conveyance chamber 22 is carried to the toner supply roller 30 by the supply conveyance screw 25*b*. Then, a magnetic brush (not shown) is formed on the toner supply roller 30. The magnetic brush on the toner supply roller 30, after having a layer thickness thereof restricted by the ear-cutting blade 33, is carried, by the rotation of the toner supply roller 30, to an area where the toner supply roller 30 and the development roller 31 are opposing each other. Then, a toner thin layer is formed on the development roller 31 by a potential difference ΔV between the Vmag(DC) applied to the toner supply roller 30 and the Vslv(DC) applied to the development roller 31, and by the magnetic field. In other words, the toner supply roller 30 supplies toner to the development roller 31 in the area opposing the development roller 31.

The thickness of the toner layer on the development roller 31 varies depending on a resistance of the developer, a difference in rotational speed between the toner supply roller 30 and the development roller 31, and so on, but can be controlled by the potential difference ΔV. The thickness of the toner layer on the development roller 31 increases as the potential difference ΔV is increased, and the thickness of the toner layer decreases as the potential difference ΔV is decreased. Generally, an appropriate range of the potential difference ΔV at the time of development is approximately 100 V to 350 V.

The toner thin layer, which is formed on the development roller 31 as a result of the contact with the magnetic brush formed on the toner supply roller 30, is carried, by the rotation of the development roller 31, to an area where the photosensitive drum 1*a* and the development roller 31 are opposing each other. To the development roller 31, Vslv(DC) and Vslv (AC) are applied. Therefore, the potential difference between the development roller 31 and the photosensitive drum 1*a* causes the toner to fly from the development roller 31 to the photosensitive drum 1*a*. In other words, the development roller 31 supplies toner to the photosensitive drum 1*a* in the area opposing the photosensitive drum 1*a*. As a result, the electrostatic latent image on the photosensitive drum 1*a* is developed.

The remaining toner that was not used for the development is carried again to the area where the development roller 31 and the toner supply roller 30 are opposing each other, and is collected by the magnetic brush on the toner supply roller 30. Then, after being taken off the toner supply roller 30 at a portion having the same magnetic polarity in the fixed magnetic member 30*b*, the toner drops into the supply conveyance chamber 22.

Subsequently, based on the result of the detection by the toner density sensor (not shown), a predetermined amount of toner is supplied into the developer container 20 through the toner supply port (not shown). The developer, supplied with toner, becomes a two component developer again that is uniformly charged at an appropriate toner density while circulating in the supply conveyance chamber 22 and the stir conveyance chamber 21. This developer is again supplied onto the toner supply roller 30 by the supply conveyance screw 25*b* and forms a magnetic brush, to be carried to the ear-cutting blade 33.

The developer container 20 includes an internal wall opposing the development roller 31, between the ear-cutting blade 33 and the photosensitive drum 1*a*. The developer container 20 includes a sleeve cover 37 forming the internal wall. The sleeve cover 37 is a separate member from the developer container 20.

Specifically, the description is as follows. In the vicinity of the development roller 31 in a right wall in FIG. 3 in the developer container 20, the sleeve cover 37 is provided projecting inward of the developer container 20. The sleeve cover 37 is quasi V-shaped in cross section. As shown in FIG. 3, the sleeve cover 37 is disposed in a longitudinal direction of the developer container 20 (in a direction perpendicular to the plane of paper in FIG. 3). A top surface 37*a* of the sleeve cover 37 (see FIG. 4) forms the internal wall opposing the development roller 31 in the developer container 20.

At an upper end of the sleeve cover 37, a seal member 39 in a form of film is provided. The seal member 39 has a tip extended in a longitudinal direction of the sleeve cover 37 (a direction perpendicular to the plane of paper in FIG. 3), so as to be in contact with a surface of the photosensitive drum 1*a* (see FIG. 1). The seal member 39 has a function to shut off the toner in the developer container 20 from leaking out.

Figure 4:
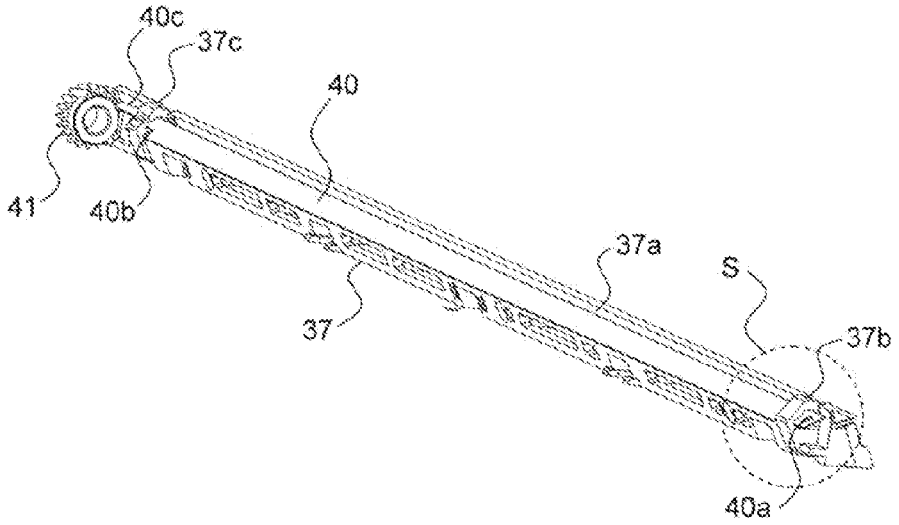
FIG. 4 is a perspective view of a sleeve cover 37 used for the development device 3*a* according to the first embodiment of the present disclosure, as viewed from an inside of a developer container 20.
Figure 5:
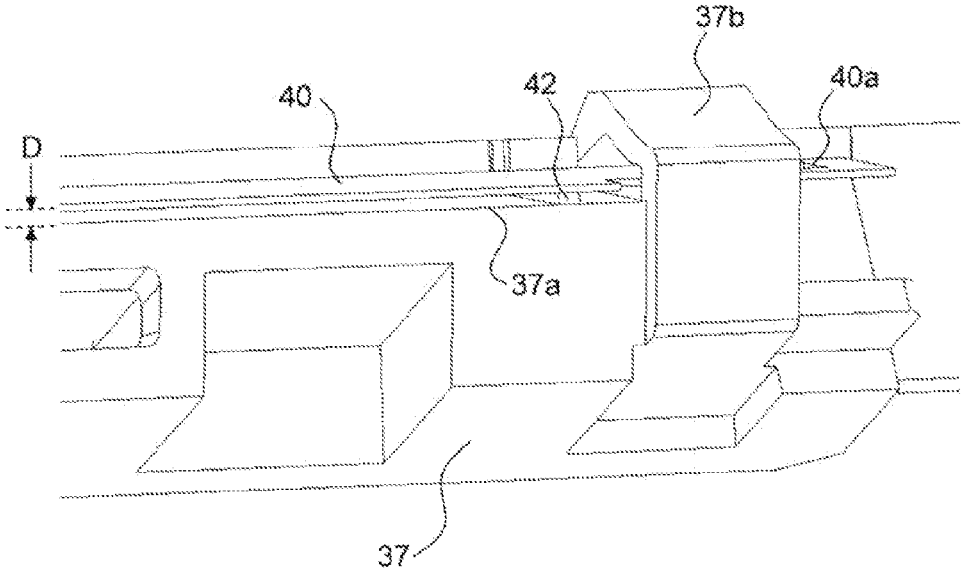
FIG. 5 is an enlarged perspective view of a vicinity of a rear-side edge of the sleeve cover 37 used for the development device 3*a* according to the first embodiment of the present disclosure.

FIG. 4 is a perspective view of the sleeve cover 37 as viewed from an inside of the developer container 20 (the left side in FIG. 3). FIG. 5 is an enlarged perspective view of a vicinity of a rear side end of the sleeve cover 37 (within a dashed line circle S in FIG. 4).

On the top surface 37*a* of the sleeve cover 37, a film member 40 is supported in the longitudinal direction. The film member 40 has flexibility. For example, the film member 40 includes a flexible material made of resin such as a polyethylene terephthalate (PET) film. As shown in FIG. 4, the film member 40 is disposed in an almost entire area of the top surface 37*a* of the sleeve cover 37.

It should be noted that the film member 40 should preferably be formed of a material having a weaker toner adhesion than the sleeve cover 37 (internal wall). For example, for the material of the film member 40, it is preferable to use a fluororesin film and the like or to coat the film member 40 with fluororesin so that less toner is likely to be attached than to the sleeve cover 37. In addition, the film member 40 is to be vibrated with tension provided as described below, and therefore needs to have a certain level of restoring force (toughness).

At the end of the rear side (the right side in FIG. 4) and the front side (the left side in FIG. 4) of the top surface 37*a* of the sleeve cover 37, a guide section 37*b* and a guide section 37*c* are formed. One and the other ends of the film member 40 are inserted, respectively, into the guide section 37*b* and the guide section 37*c*. At the rear side end of the film member 40, a locking hole 40*a* is provided. In the locking hole 40*a*, one end of a coil spring 43 (see FIG. 6) is locked. In addition, at a side end edge in the front side of the film member 40, a notch 40*b* having a rectangular shape is formed. The notch 40*b* is formed at a position opposing the guide section 37*c*.

Then, an end of the front side of the film member 40 is formed as a protruding piece 40*c* that is further extended toward the front side through the guide section 37*c*, to reach a vicinity of an idler gear 41. The idler gear 41 is connected to a drive input gear 45*a* of the toner supply roller 30 (see FIG. 8) and a drive input gear 45*b* of the development roller 31 (See FIGS. 7 and 8).

In addition, as shown in FIG. 5, on the top surface 37*a* of the sleeve cover 37, a rib 42 is provided in the vicinity of the guide section 37*b* on the rear side. It should be noted that although not shown here, another rib 42 having the same height is provided in the vicinity of the guide section 37*c* on the front side. With these two ribs 42, the film member 40 is supported (disposed) at a predetermined distance D (second predetermined distance) from the top surface 37*a* (internal wall) of the sleeve cover 37. The film member 40 can vibrate in a direction in which the film member 40 moves closer to or apart from the top surface 37*a* (internal wall) of the sleeve cover 37.

Figure 6:
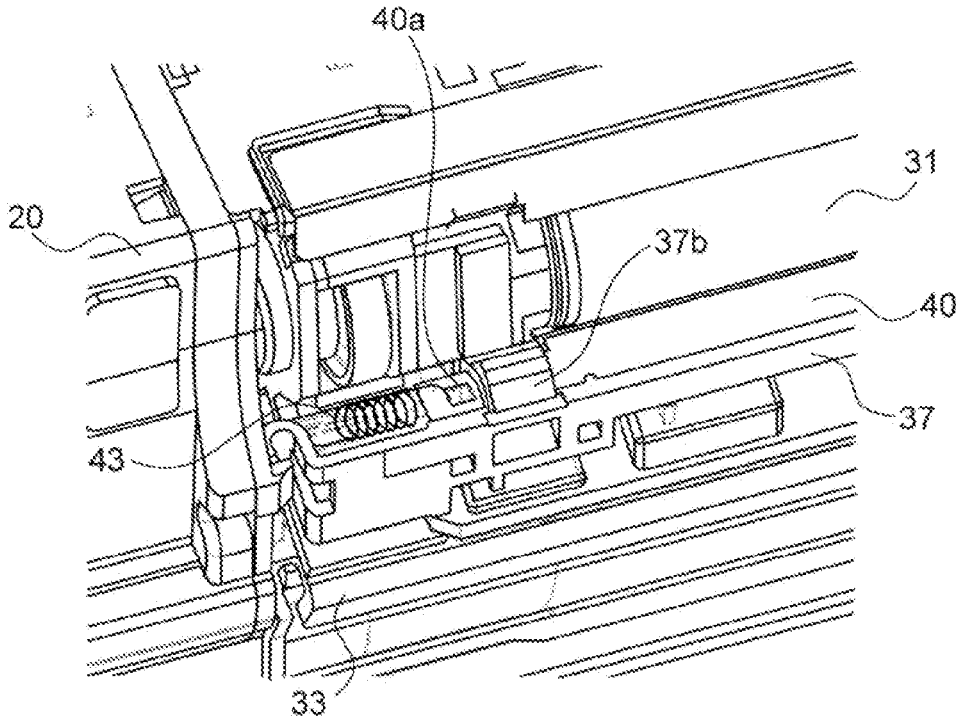
FIG. 6 is an enlarged perspective view of a rear side of the development device 3*a* according to the first embodiment of the present disclosure, as viewed from a side of a photosensitive drum 1*a*.
Figure 7:
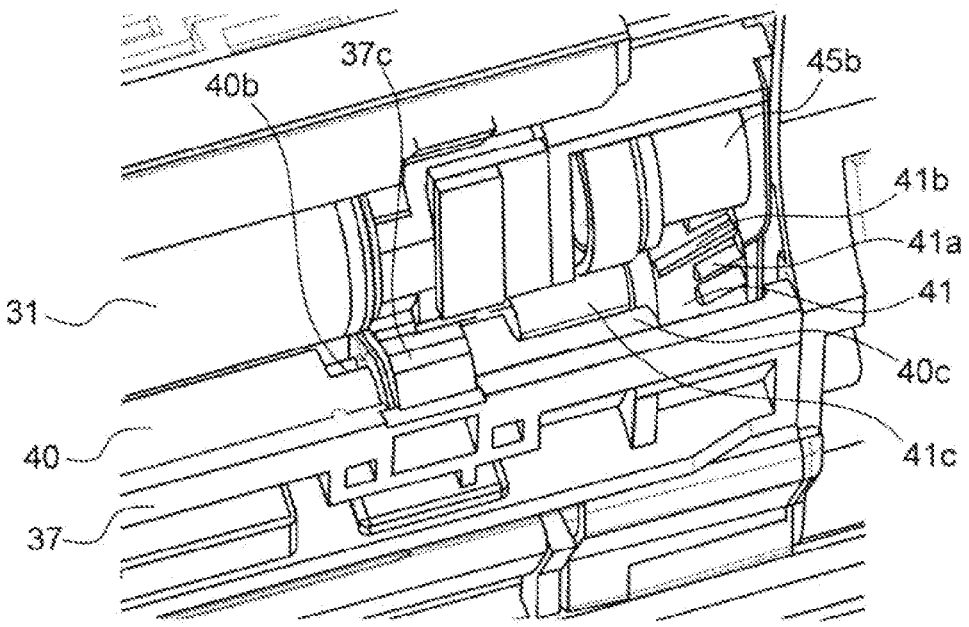
FIG. 7 is an enlarged perspective view of a front side of the development device 3*a* according to the first embodiment of the present disclosure, as viewed from the side of the photosensitive drum 1*a*.

Each of FIG. 6 and FIG. 7 is a partial enlarged view of a vicinity of the rear side and the front side of the sleeve cover 37 mounted to the development device 3*a*. It should be noted that FIGS. 6 and 7 show a state of the sleeve cover 37 as viewed from an outside of the development device 3*a* (the right side in FIG. 3). FIGS. 6 and 7 and FIGS. 4 and 5, when compared, are left-right reversal.

As shown in FIG. 6, the coil spring 43 is connected to at least one end of the film member 40 in the longitudinal direction. The coil spring 43 functions as a biasing member. The coil spring 43 provides tension to the film member 40. Specifically, the description is as follows.

At the rear side of the sleeve cover 37, one end of the coil spring 43 is locked in the locking hole 40*a* of the film member 40. The other end of the coil spring 43 is locked in a locking portion (not shown) in the sleeve cover 37. On the other hand, as shown in FIG. 7, in the front side of the sleeve cover 37, the notch 40*b* is caught by the guide section 37*c*, thereby restricting the movement of the film member 40 in the longitudinal direction. The notch 40*b* is formed at the side end edge of the film member 40.

With this configuration, one end of the film member 40 (rear side end) is biased toward the rear side by the coil spring 43. On the other hand, the movement of the other end (front side end) of the film member 40 is restricted by the engagement between the notch 40*b* and the guide section 37*c*. As a result, the film member 40 is provided with a predetermined tension in the longitudinal direction.

In addition, a tip of the protruding piece 40*c* is located in the vicinity of an outer circumferential surface of the idler gear 41 disposed in the front side of the development device 3*a*. The protruding piece 40*c* is a front side end of the film member 40 that is extended beyond the guide section 37*c* on the front side of the sleeve cover 37. The idler gear 41 includes a plurality of gear teeth 41*a*. The idler gear 41 includes a projection 41*b*. The projection 41*b* is formed by extending one of the gear teeth 41*a* inwardly in the outer circumferential surface of the idler gear 41.

Figure 8:
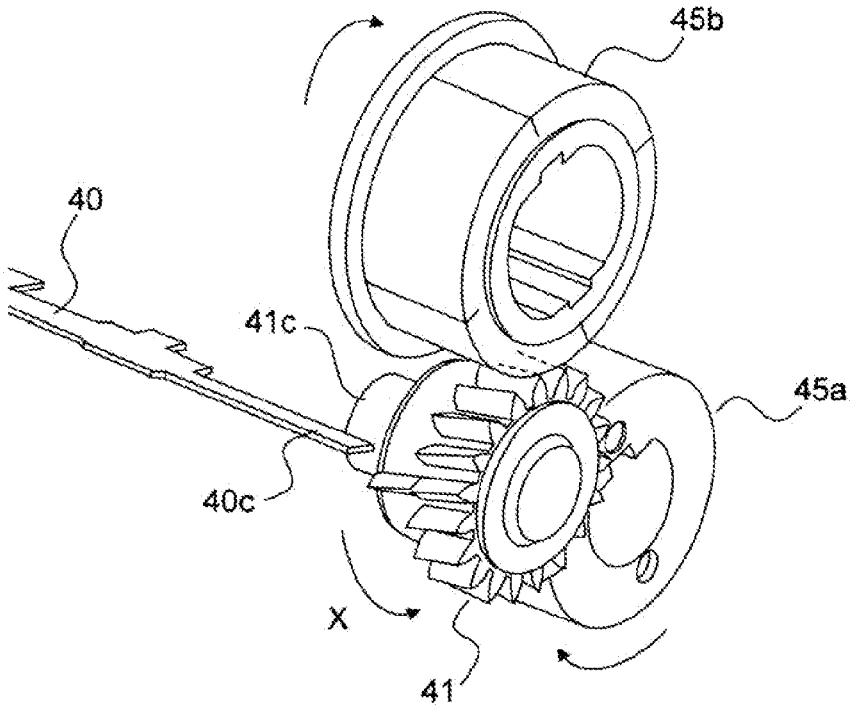
FIG. 8 is a schematic perspective view showing a positional relationship between an idler gear 41, a drive input gear 45*a*, a drive input gear 45*b*, and a protruding piece 40*c* in a film member 40, when the toner supply roller 30 rotates forward, in the development device 3*a* according to the first embodiment of the present disclosure.
Figure 9:
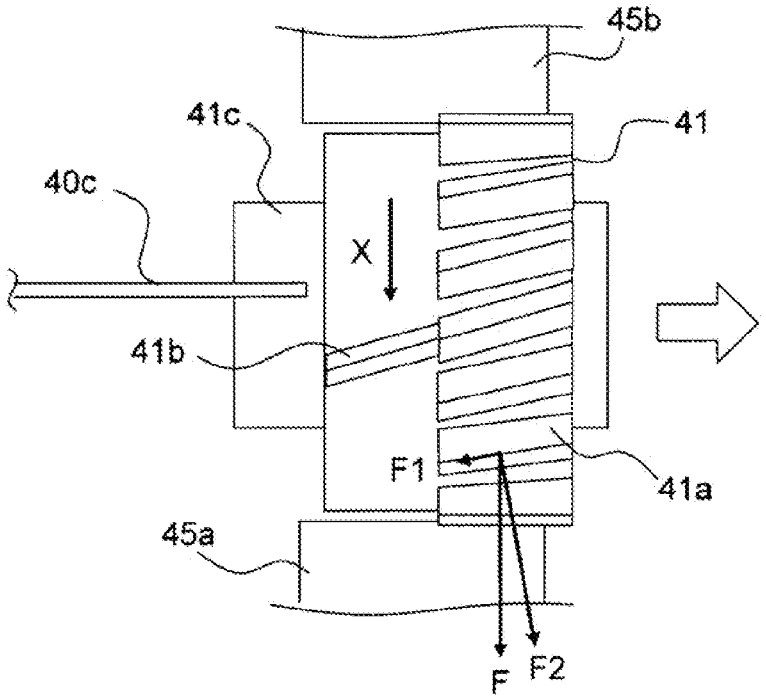
FIG. 9 is a partial enlarged view showing a state of engagement between the idler gear 41, the drive input gear 45*a*, and the drive input gear 45*b* in FIG. 8, in the development device 3*a* according to the first embodiment of the present disclosure.

FIG. 8 is a schematic perspective view showing a positional relationship between the idler gear 41, the drive input gear 45*a*, the drive input gear 45*b*, and the protruding piece 40*c* in the film member 40, when the toner supply roller 30 rotates forward. FIG. 9 is a partial enlarged view showing a state of engagement between the idler gear 41, the drive input gear 45*a*, and the drive input gear 45*b* in FIG. 8. The drive input gear 45*a* functions as a first drive input gear. The drive input gear 45*b* functions as a second drive input gear. It should be noted that the idler gear 41 is a helical gear. Therefore, both the drive input gear 45*a* and the drive input gear 45*b* that are to be engaged with the idler gear 41 are also helical gears. However, in FIGS. 8 and 9, descriptions of the gear teeth in each of the drive input gears 45*a* and 45*b* are omitted.

The idler gear 41 is engaged with the drive input gear 45*a* and the drive input gear 45*b*. The drive input gear 45*a* provides an input of rotational drive force to the toner supply roller 30. The drive input gear 45*b* provides an input of rotational drive force to the development roller 31. To the drive input gear 45*a*, a drive motor (not shown) is connected. Then, the rotational drive force of the drive input gear 45*a* is transmitted to the drive input gear 45*b* via the idler gear 41. In addition, the idler gear 41 is movably extrapolated into a thrust direction with respect to the rotational axis 41*c* (horizontal direction in FIG. 9).

When image formation is performed, by rotating the toner supply roller 30 and the development roller 31 forward (rotating in an anticlockwise direction in FIG. 3), the idler gear 41 engaged with the drive input gear 45*a* and the drive input gear 45*b* rotates in a direction pointed by arrow X in FIGS. 8 and 9. At this time, as shown in FIG. 9, a pressing force F for pressing downward is provided to the gear teeth 41*a* of the idler gear 41 by the drive input gear 45*a*. The pressing force F is divided into a force component F1 and a force component F2. The force component F1 is a component of force that is parallel to an extension direction of the gear teeth 41*a*. The force component F2 is a component of force that is perpendicular to the extension direction of the gear teeth 41*a*.

Here, the force component F2 works to press the idler gear 41 rightward. Accordingly, the idler gear 41 moves rightward along the rotational axis 41*c*. As a result, the projection 41*b* provided in the outer circumferential surface of the idler gear 41 is positioned at a position (first position) where the projection 41*b* is apart from the protruding piece 40*c* in the film member 40, so that the film member 40 remains stationary without vibration even when the idler gear 41 rotates.

Figure 10:
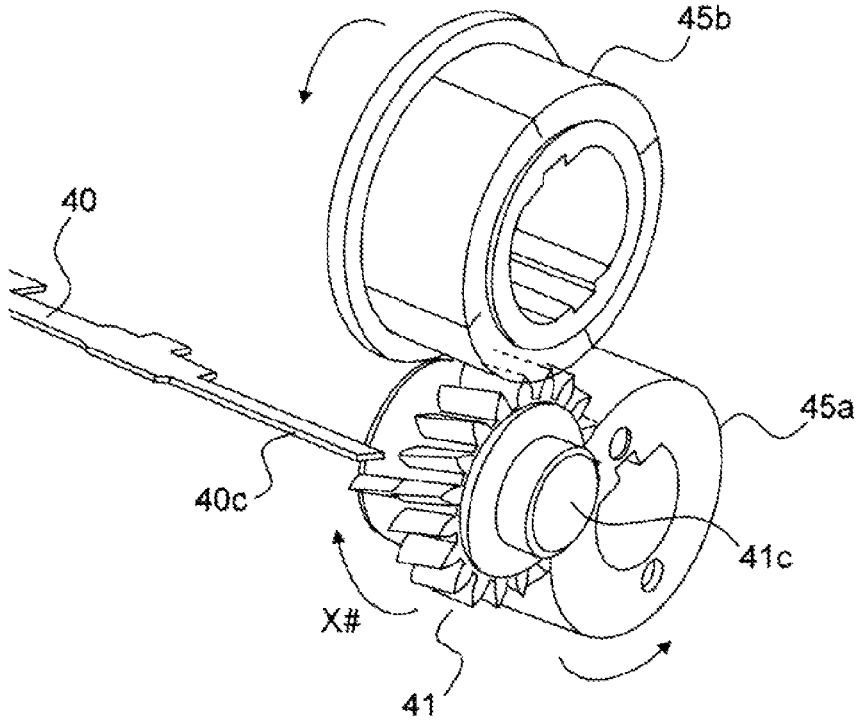
FIG. 10 is a schematic perspective view showing a positional relationship between the idler gear 41, the drive input gear 45*a*, the drive input gear 45*b*, and the protruding piece 40*c* in the film member 40, in the development device 3*a* according to the first embodiment of the present disclosure, when the toner supply roller 30 reversely rotates.
Figure 11:
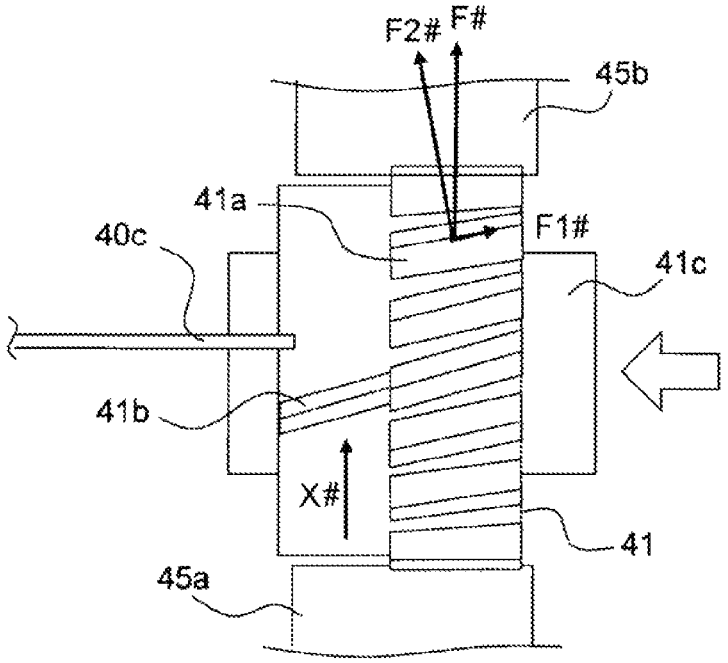
FIG. 11 is a partial enlarged view showing a state of engagement between the idler gear 41, the drive input gear 45*a*, and the drive input gear 45*b* in FIG. 10, in the development device 3*a* according to the first embodiment of the present disclosure.

FIG. 10 is a schematic perspective view showing a positional relationship between the idler gear 41, the drive input gear 45*a*, the drive input gear 45*b*, and the protruding piece 40*c* in the film member 40, when the toner supply roller 30 reversely rotates. FIG. 11 is a partial enlarged view showing a state of engagement between the idler gear 41, the drive input gear 45*a*, and the drive input gear 45*b* in FIG. 10. It should be noted that, in FIGS. 10 and 11, as with FIGS. 8 and 9, the descriptions of the gear teeth in each of the drive input gears 45*a* and 45*b* are omitted.

When image formation is not performed, by reversely rotating the toner supply roller 30 and the development roller 31 (rotating in a clockwise direction in FIG. 3), the idler gear 41, which transmits a drive force to the drive input gear 45*b* of the development roller 31, rotates in a direction pointed by arrow X# in FIG. 10 and FIG. 11. At this time, as shown in FIG. 11, a pressing force F# for pushing upward is provided to the gear teeth 41*a* of the idler gear 41 by the drive input gear 45*a*. The pressing force F# is divided into a force component F1# and a force component F2#. The force component F1# is a component of force parallel to the extension direction of the gear teeth 41*a*. The force component F2# is a component of force that is perpendicular to the extension direction of the gear teeth 41*a*.

Here, since the force component F2# works to press the idler gear 41 leftward, the idler gear 41 moves leftward along the rotational axis 41*c*. Accordingly, the projection 41*b* provided in the outer circumferential surface of the idler gear 41 is positioned at a position (second position) where the projection 41*b* overlaps with an end edge of the protruding piece 40*c* in the film member 40. As a result, the projection 41*b* comes into contact with the end edge of the protruding piece 40*c* in the film member 40 each time the idler gear 41 rotates one revolution, so that the film member 40, provided with tension, is caused to vibrate like a string of a stringed instrument.

It should be noted that a moving range along the rotational axis 41*c* of the idler gear 41 should preferably be adjusted such that the overlap of the projection 41*b* and the end edge of the protruding piece 40*c* is approximately 2 mm when the idler gear 41 moves most leftward (in a direction toward the protruding piece 40*c*). The amount of movement along the rotational axis 41*c* of the idler gear 41 is adjustable by a tilt of the gear teeth 41*a* and the amount of rotation (rotation angle) of the idler gear 41. Especially, the amount of movement along the rotational axis 41*c* of the idler gear 41 when image formation is not performed is adjustable by the tilt of the gear teeth 41*a* and the amount of rotation of the idler gear 41 when image formation is not performed (that is, reverse rotation amount (reverse rotation angle) of the idler gear 41).

As has been described with reference to figures FIG. 8 to FIG. 11, the idler gear 41 is reciprocally movable between the first position and the second position along the rotational axis 41*c* of the idler gear 41. The first position is a position where the projection 41*b* is apart from the end edge of the film member 40 (protruding piece 40*c*) in response to the rotation of the toner supply roller 30 when image formation is performed. The second position is a position where the projection 41*b* overlaps with the end edge of the film member 40 (protruding piece 40*c*) in response to the reverse rotation of the toner supply roller 30 when image formation is not performed.

The idler gear 41, when image formation is performed, is positioned at the first position by rotating the toner supply roller 30. On the other hand, the idler gear 41, when image formation is not performed, is positioned at the second position by rotating the toner supply roller 30 in a direction opposite to the direction in performing image formation. The projection 41*b* of the idler gear 41 causes the film member 40 to vibrate by intermittently coming into contact with the end edge of the film member 40 (protruding piece 40*c*) along with the rotation of the idler gear 41 positioned at the second position.

Figure 12:
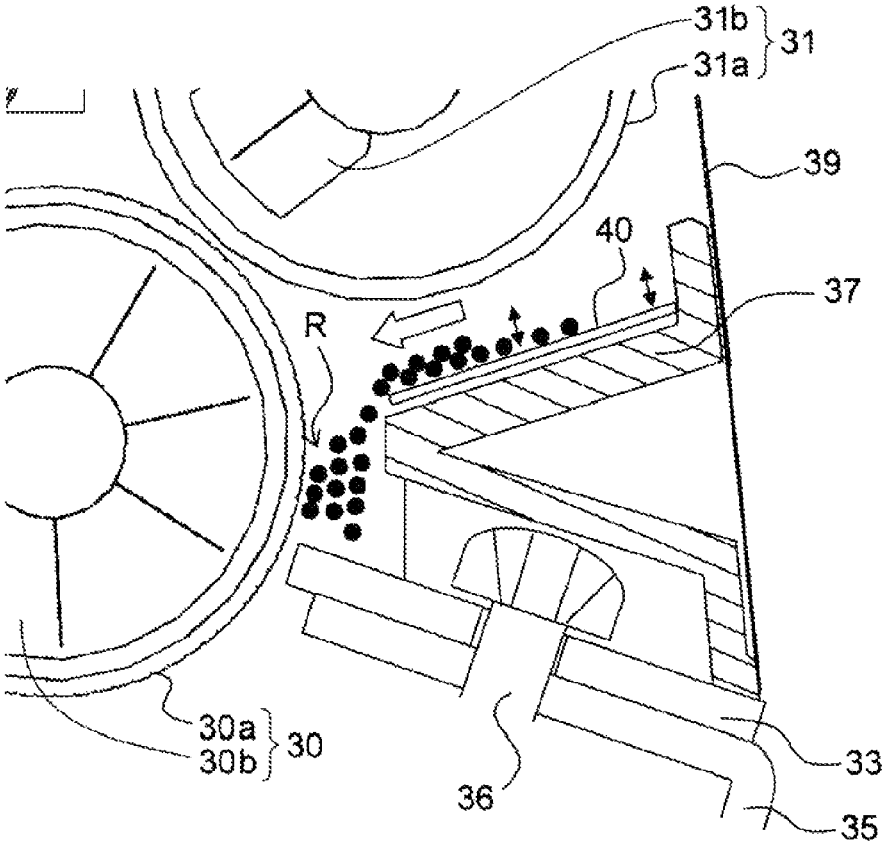
FIG. 12 is a side cross-sectional view of a vicinity of the sleeve cover 37 of the development device 3*a* according to the first embodiment of the present disclosure.

FIG. 12 is a partial cross-sectional view of a vicinity of the sleeve cover 37 of the development device 3*a*. Due to the vibration in the film member 40 when image formation is not performed, as shown in FIG. 12, the toner accumulating on the film member 40 becomes separated and shaken off. As a result, the toner supply roller 30 and the development roller 31 in the development device 3*a* rotate at high speed, thereby allowing suppressing toner accumulation on the top surface 37*a* of the sleeve cover 37 even if there is a large amount of toner floating in the developer container 20. The toner shaken off the film member 40 falls onto a region R that is sandwiched between the sleeve cover 37 and the toner supply roller 30.

The toner, fallen onto the region R and temporarily accumulating in the vicinity of the tip of the ear-cutting blade 33, is collected by a magnetic brush formed on the surface of the toner supply roller 30 that is reversely rotating. The collected toner passes through the gap between the toner supply roller 30 and the ear-cutting blade 33 along with the reverse rotation of the toner supply roller 30. Then, the toner is taken off the toner supply roller 30 at a potion having the same polarity in the fixed magnetic member 30*b*, to be forcibly returned to the supply conveyance chamber 22 (See FIG. 3).

Thus, it is possible to suppress adhesion of toner to the toner supply roller 30 or the development roller 31, which is caused by aggregation of (blocking by) the toner having accumulated on the top surface 37*a* of the sleeve cover 37. As a result, it is possible to effectively suppress an image defect due to toner drop and so on, without depending on the rotation speeds of the toner supply roller 30 and the development roller 31.

On the other hand, the film member 40 does not vibrate at a time of image formation when the toner supply roller 30 and the development roller 31 rotate forward. Therefore, it is less likely that the toner, having accumulated on the film member 40, is shaken off and falls onto the toner supply roller 30 when image formation is performed. As a result, it is also possible to prevent the occurrence of an image defect due to toner drop. Then, by reversing the rotation of the toner supply roller 30 and the development roller 31 when image formation is not performed, it is possible to vibrate the film member 40 so as to shake off the accumulated toner, collect the toner by the magnetic brush of the toner supply roller 30 that is reversing rotation, and efficiently return the collected toner to the supply conveyance chamber 22.

In addition, to prevent toner accumulation by vibrating the film member 40, it is not necessary to separately provide a toner removing member like a brush member for removing the toner on the sleeve cover 37. As a result, it is possible to achieve compactness and space saving. In addition, it is less likely that a foreign substance derived from the toner removing member circulates with the developer in the developer container 20. As a result, it is possible to effectively prevent an image defect such as a void image caused by the foreign substance stuck in a gap between the ear-cutting blade 33 and the toner supply roller 30.

Furthermore, the film member 40 is caused to vibrate using the rotation of the idler gear 41 that inevitably rotates when the toner supply roller 30 and the development roller 31 rotate. Therefore, it is not necessary to separately provide a dedicated motor, an actuator, and so on for providing vibration to the film member 40. As a result, it is possible to simplify the internal configuration of the development device 3*a*.

It should be noted that in the present embodiment, one projection 41*b* is provided in the outer circumferential surface of the idler gear 41 (see FIG. 10 and FIG. 11). However, the number of projections 41*b* is arbitrarily adjustable depending on the rotation speed and/or the rotation time of the toner supply roller 30 and the development roller 31 when image formation is not performed (that is, the reverse rotation speed and/or the reverse rotation time of the toner supply roller 30 and the development roller 31). For example, the lower the reverse rotation speed of the toner supply roller 30 and the development roller 31, the lower the rotation speed of the idler gear 41. In addition, the shorter the reverse rotation time of the toner supply roller 30 and the development roller 31, the shorter the rotation time of the idler gear 41. When the rotation speed of the idler gear 41 is low and/or when the reverse rotation time of the idler gear 41 is short, it is possible to sufficiently vibrate the film member 40 by increasing the number of projections 41*b* and thereby increasing the number of contacts with the protruding piece 40*c* in the film member 40.

The timing for reversely rotating the toner supply roller 30 and the development roller 31 is at a predetermined point in time, for example, when printing operation is finished, when the number of printed pages reaches a predetermined number, or when the temperature within the development device 3*a* is not less than a predetermined level, and so on. In addition, for example, the reverse rotation may be performed each time the printing operation is finished.

In the meantime, in single printing, toner is more likely to accumulate on the film member 40 than in continuous printing. The reason can be considered that the rotation of the toner supply roller 30 and the development roller 31 intermittently stops during single printing, thus causing less air flow within the developer container 20 than in continuous printing. Likewise, since the fluidity of toner decreases in high-temperature high-humidity environment, the toner is more likely to accumulate on the film member 40 than in an environment under normal temperature and normal humidity.

Thus, during single printing, the toner supply roller 30 and the development roller 31 are caused to reversely rotate, for every smaller number of pages than in continuous printing. Under the high-temperature high-humidity environment, the toner supply roller 30 and the development roller 31 are caused to reverse the rotation, for every smaller number of pages than in the environment under normal temperature and normal humidity. As a result, even in single printing and under the high-temperature and high-humidity environment, it is possible to effectively prevent toner accumulation on the film member 40.

Second Embodiment

Figure 13:
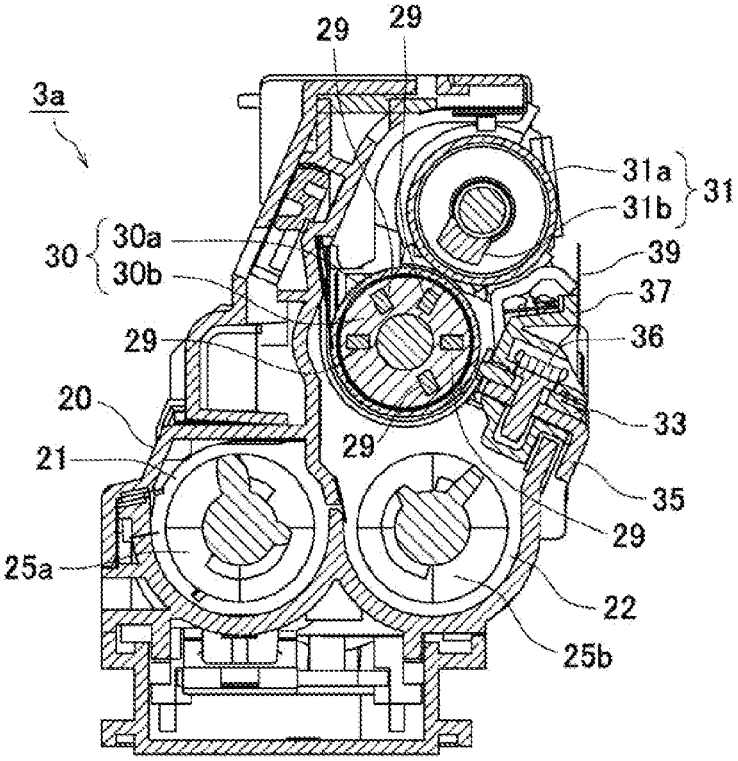
FIG. 13 is a side cross-sectional view of the development device 3*a* according to a second embodiment of the present disclosure.
Figure 14:
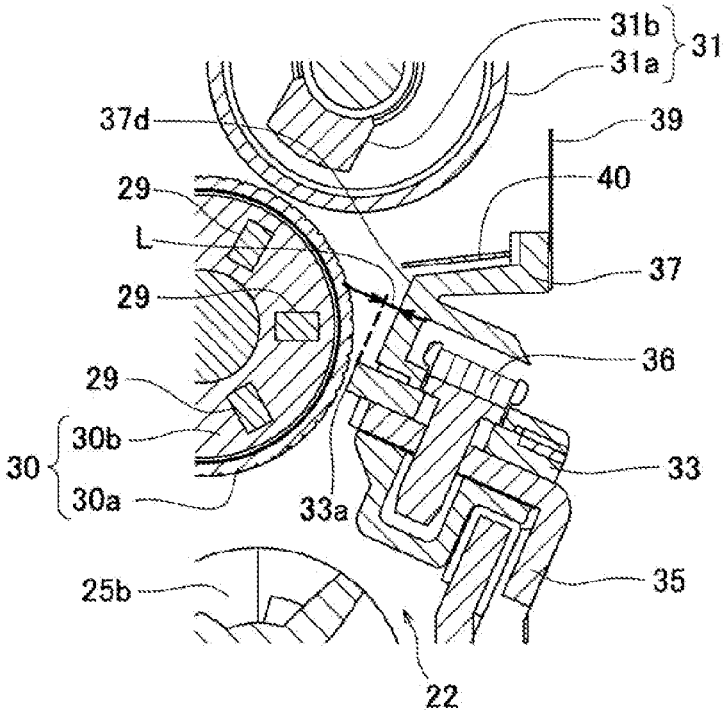
FIG. 14 is a partial enlarged view of a periphery of an ear-cutting blade 33 in FIG. 13, in the development device 3*a* according to the second embodiment of the present disclosure.

FIG. 13 is a side cross-sectional view of a development device 3*a* according to a second embodiment of the present disclosure. FIG. 14 is a partial enlarged view of a vicinity of an ear-cutting blade 33 in FIG. 13. According to the present embodiment, the development device 3*a* includes a positioning mechanism. The positioning mechanism positions a sleeve cover 37 with respect to the ear-cutting blade 33. Then, the positioning mechanism allows maintaining, at a constant level, a distance L between an opposite surface 37*d* of the sleeve cover 37, which is a surface opposing a toner supply roller 30, and an edge 33*a* (a tip) of the ear-cutting blade 33. The configuration of another portion of the development device 3*a* and a mechanism for vibrating a film member 40 are the same as those in the first embodiment and therefore the descriptions thereof are omitted.

In collecting the toner fallen from the film member 40 onto the ear-cutting blade 33, the distance L is extremely important. If the distance L is too large, and when rotating the toner supply roller 30 in the opposite direction, the magnetic brush does not reach the toner that has accumulated in the vicinity of the opposite surface 37*d* on the ear-cutting blade 33. As a result, it is not possible to sufficiently collect the toner. On the other hand, if the distance L is too small, the toner falls directly onto the toner supply roller 30 from the film member 40 during image formation. As a result, an image defect occurs due to toner drop.

Thus, as described in the present embodiment, a positioning mechanism is provided for positioning the sleeve cover 37 with respect to the ear-cutting blade 33. Thus, it is possible to constantly maintain the distance L at a constant level. As a result, it is possible to effectively suppress insufficient collection of the toner accumulating on the ear-cutting blade 33 and occurrence of an image defect due to toner drop.

Figure 15:
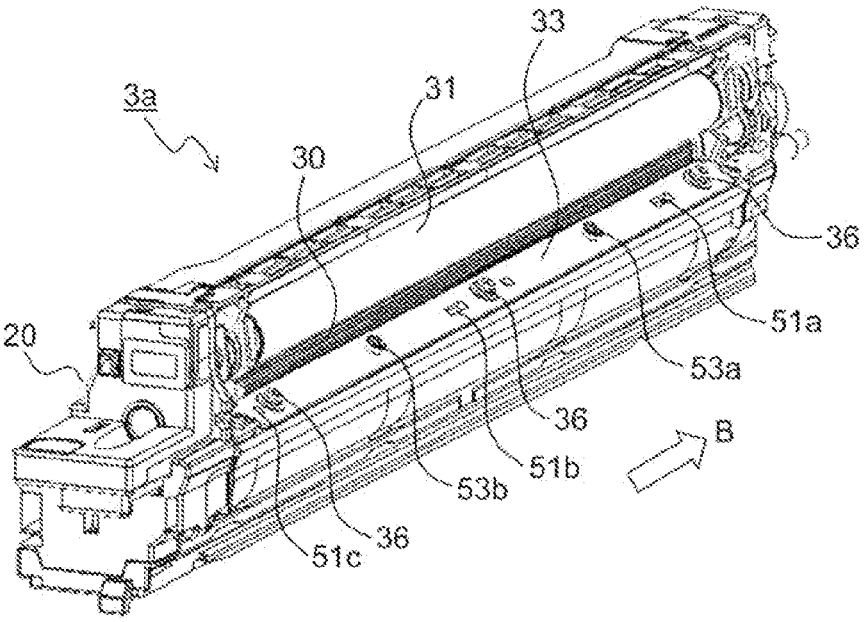
FIG. 15 is a perspective view showing a state in which the sleeve cover 37 is removed from the development device 3*a* according to the second embodiment of the present disclosure.
Figure 16:
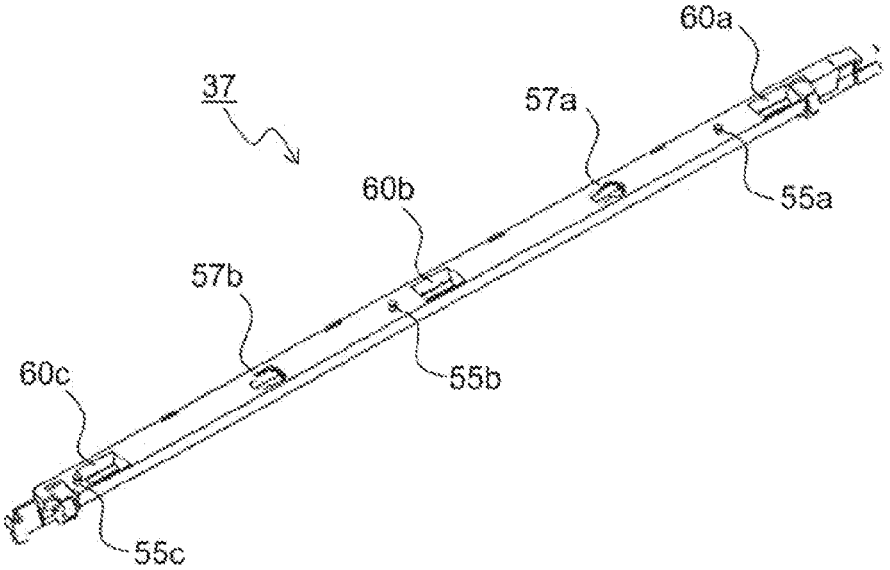
FIG. 16 is a perspective view of the sleeve cover 37 used for the development device 3*a* according to the second embodiment of the present disclosure, as viewed from a contact surface side on which the sleeve cover 37 has contact with the ear-cutting blade 33.

Next, the following describes, more specifically, the positioning mechanism for the sleeve cover 37 according to the present embodiment. FIG. 15 is a perspective view showing a state in which the ear-cutting blade 33 is exposed by removing the sleeve cover 37 from the development device 3*a* according to the present embodiment. FIG. 16 is a perspective view of the sleeve cover 37 used for the development device 3*a* according to the present embodiment as viewed from a back side (a contact surface side having contact with the ear-cutting blade 33).

The positioning mechanism includes a positioning pin 53*a* and a positioning pin 53*b*, and a pin hole 57*a* and a pin hole 57*b* corresponding to the positioning pins 53*a* and 53*b*. The positioning pins 53*a* and 53*b* are formed on the top surface of the ear-cutting blade 33. The pin holes 57*a* and 57*b* are formed in the sleeve cover 37, on the surface having contact with the top surface of the ear-cutting blade 33.

In addition, the positioning mechanism further includes: a first positioning boss 55*a* and a first positioning boss 55*b*, and a first positioning hole 51*a* and a first positioning hole 51*b*. The first positioning bosses 55*a* and 55*b* are formed in the sleeve cover 37, on the surface having contact with the ear-cutting blade 33. The first positioning holes 51*a* and 51*b* are formed on the top surface of the ear-cutting blade 33, corresponding to the first positioning bosses 55*a* and 55*b*.

Furthermore, the positioning mechanism further includes a second positioning boss 55*c* and a second positioning hole 51*c*. The second poisoning boss 55*c* is formed in the sleeve cover 37, on a surface having contact with the ear-cutting blade 33. The second positioning hole 51*c* is formed on the top surface of the ear-cutting blade 33, corresponding to the second positioning boss 55*c*. In addition, the second positioning hole 51*c* is formed in the same shape as the second positioning boss 55*c*.

The following describes the positioning mechanism in further details. As shown in FIG. 15, the ear-cutting blade 33 is fixed by fastening with blade fixing screws 36, to a blade support stay 35 mounted to the developer container 20. In addition, on the top surface of the ear-cutting blade 33, formed are: the first positioning hole 51*a* and the first positioning hole 51*b* at two points, and the second positioning hole 51*c* at one point. The first positioning holes 51*a* and 51*b* are elongated holes along the longitudinal direction of the ear-cutting blade 33. The second positioning hole 51*c* is a round hole having the same shape as the second positioning boss 55*c* (see FIG. 16). At two points on the top surface of the ear-cutting blade 33, the positioning pins 53*a* and 53*b* are formed.

As shown in FIG. 16, on the back surface of the sleeve cover 37, the first positioning boss 55*a* that is to be engaged with the first positioning hole 51*a* in the ear-cutting blade 33 (see FIG. 15) and the first positioning boss 55*b* that is to be engaged with the first positioning hole 51*b* in the ear-cutting blade 33 (see FIG. 15) are provided in a projecting manner. On the back surface of the sleeve cover 37, the second positioning boss 55*c* that is to be engaged with the second positioning hole 51*c* in the ear-cutting blade 33 (see FIG. 15) is provided in a projecting manner.

In addition, in the back surface of the sleeve cover 37, formed are: the pin hole 57*a* and the pin hole 57*b* at two points, and a clearance hole 60*a*, a clearance hole 60*b*, and a clearance hole 60*c* at three points. With the pin hole 57*a*, the positioning pin 53*a* in the ear-cutting blade 33 (see FIG. 15) is to be engaged. With the pin hole 57*b*, the positioning pin 53*b* in the ear-cutting blade 33 (see FIG. 15) is to be engaged. The clearance holes 60*a* to 60*c* are provided to avoid interference between the blade fixing screws 36 (see FIG. 15) and the sleeve cover 37.

Figure 17:
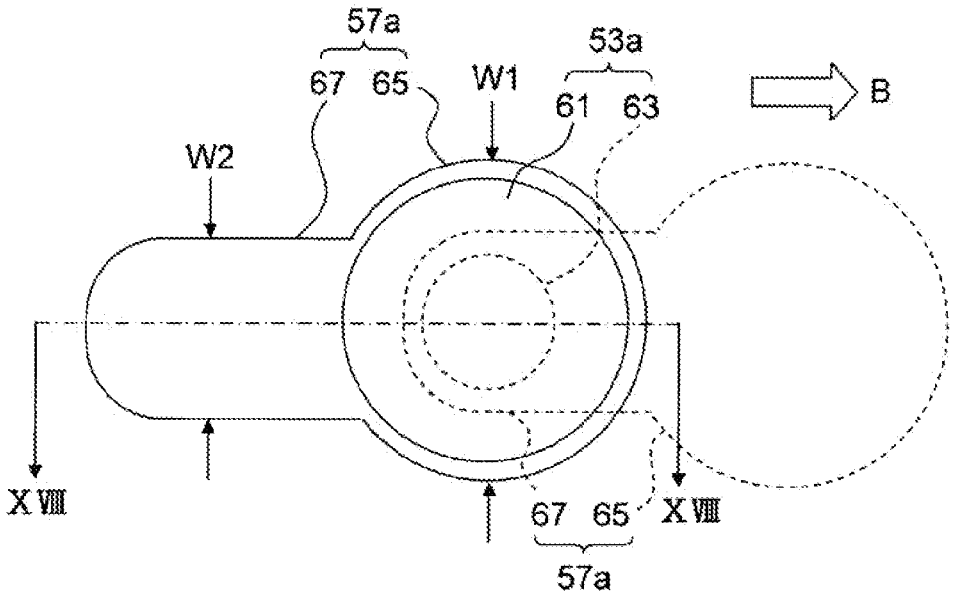
FIG. 17 is a plan view showing a state in which a positioning pin 53*a* is engaged with a pin hole 57*a*, in the development device 3*a* according to the second embodiment of the present disclosure.
Figure 18:
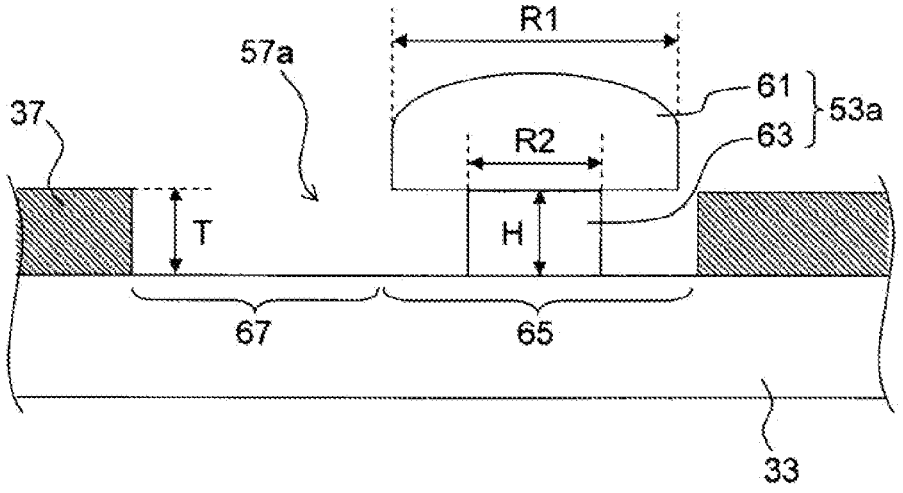
FIG. 18 is a cross-sectional view showing a state in which the positioning pin 53*a* is engaged with the pin hole 57*a*, in the development device 3*a* according to the second embodiment of the present disclosure.

FIG. 17 is a plan view showing a state of engagement between the positioning pin 53*a* and the pin hole 57*a*. FIG. 18 is a cross-sectional view showing a state of engagement between the positioning pin 53*a* and the pin hole 57*a* (cross sectional view taken along line XVIII-XVIII in FIG. 17). The following describes a relationship between the positioning pin 53*a* and the pin hole 57*a*, but the relationship between the positioning pin 53*b* (see FIG. 15) and the pin hole 57*b* (see FIG. 16) can be described in exactly the same way.

The positioning pin 53*a* includes a head 61 and a shank 63. The head 61 is formed on a tip of the shank 63. The shank 63 is provided on the top surface of the ear-cutting blade 33 in a projecting manner. The head 61 has a greater diameter than the diameter of the shank 63. In other words, the shank 63 has a smaller diameter than the diameter of the head 61.

The pin hole 57*a* is formed in a keyhole shape in planer view, including an engagement hole 65 having a round shape and a guide hole 67 having a shape of an elongated hole. The guide hole 67 is extended almost parallel to the longitudinal direction of the sleeve cover 37. The guide hole 67 is communicated with the engagement hole 65. The engagement hole 65 has an inner diameter W1 that is formed to be greater than a diameter R1 of the head 61 of the positioning pin 53*a*. The guide hole 67 has a width W2 that is formed to be smaller than the diameter R1 of the head 61 and greater than a diameter R2 of the shank 63. In addition, the shank 63 has a height H that is slightly greater than a thickness T of a base of the sleeve cover 37. It should be noted that the first positioning holes 51*a* and 51*b* formed in the ear-cutting blade 33 have a shape of an elongated hole that is parallel to the guide hole 67.

Next, the following describes how to attach the sleeve cover 37 with reference to figures FIG. 13 to FIG. 18. First, the sleeve cover 37 is brought into contact with the top surface of the ear-cutting blade 33 such that the engagement hole 65 for the pin hole 57*a* and the engagement hole 65 for the pin hole 57*b*, which are formed on the back surface of the sleeve cover 37, are engaged with, respectively, the positioning pin 53*a* and the positioning pin 53*b* that are formed on the top surface of the ear-cutting blade 33.

At this time, since the clearance holes 60*a* to 60*c* are formed in the back surface of the sleeve cover 37, at positions opposing the three blade fixing screws 36, the back surface of the sleeve cover 37 and the top surface of the ear-cutting blade 33 closely contact with each other.

The first positioning boss 55*a* and the first positioning boss 55*b* that are formed on the back surface of the sleeve cover 37 are engaged with, respectively, one end of the first positioning hole 51*a* and one end of the first positioning hole 51*b* (left end in FIG. 15) that are formed on the top surface of the ear-cutting blade 33. The position of the sleeve cover 37 in a width direction with respect to the ear-cutting blade 33 (the horizontal direction in FIG. 14) is determined by the engagement between the first positioning boss 55*a* and the first positioning hole 51*a* and the engagement between the first positioning boss 55*b* and the first positioning hole 51*b*. It should be noted that in this state the second positioning boss 55*c* and the second positioning hole 51*c* are not engaged with each other, thereby allowing movement in the longitudinal direction of the sleeve cover 37. In other words, the engagement of the first positioning bosses 55*a* and 55*b* with the first positioning holes 51*a* and 51*b* allows the movement of the sleeve cover 37 in a longitudinal direction with respect to the ear-cutting blade 33 and restricts the movement of the sleeve cover 37 in the width direction with respect to the ear-cutting blade 33.

Next, the sleeve cover 37 is slid in the longitudinal direction of the ear-cutting blade 33 (direction of arrow B). As a result, the first positioning boss 55*a* moves from one end of the first positioning hole 51*a* (left end in FIG. 15) to the other end (right end in FIG. 15). At the same time, the first positioning boss 55*b* moves from one end (left end in FIG. 15) of the first positioning hole 51*b* to the other end (right end in FIG. 15). In addition, the second positioning boss 55*c* and the second positioning hole 51*c* are engaged with each other, thereby restricting the movement of the sleeve cover 37 in the longitudinal direction with respect to the ear-cutting blade 33. In other words, when the sleeve cover 37 is slid to a position where each of the positioning pins 53*a* and 53*b* becomes engaged with the guide hole 67, the engagement between the second positioning boss 55*c* and the second positioning hole 51*c* restricts the movement of the sleeve cover 37 in the longitudinal direction with respect to the ear-cutting blade 33.

Then, along with sliding of the sleeve cover 37, the pin hole 57*a* engaged with the positioning pin 53*a* and the pin hole 57*b* engaged with the positioning pin 53*b* also move in the direction of arrow B (shown by dashed line in FIG. 17). As a result, an engagement position of the positioning pin 53*a* with respect to the pin hole 57*a* and an engagement position of the positioning pin 53*b* with respect to the pin hole 57*b* move from the engagement hole 65 to the guide hole 67. As described above, the head 61 of each of the positioning pins 53*a* and 53*b* has a diameter R1 that is greater than the width W2 of the guide hole 67. Therefore, a peripheral portion of the guide hole 67 is clamped between the top surface of the ear-cutting blade 33 and the head 61, thus restricting movement in the vertical direction of the sleeve cover 37 with respect to the ear-cutting blade 33. In other words, by engaging each of the positioning pins 53*a* and 53*b* with the engagement hole 65 and sliding the sleeve cover 37 to the position where the positioning pins 53*a* and 53*b* become engaged with the guide holes 67, the vertical movement of the sleeve cover 37 with respect to the ear-cutting blade 33 is restricted.

With the configuration above, the position of the sleeve cover 37 is determined in longitudinal, width, and vertical directions with respect to the ear-cutting blade 33. As a result, it is possible to maintain, at a constant level, the distance L between an opposite surface 37*d* of the sleeve cover 37, which is opposing the toner supply roller 30, and the edge 33*a* of the ear-cutting blade 33. In addition, it is possible to fix the sleeve cover 37 to the ear-cutting blade 33 without using a fixing member such as a screw. As a result, it is possible to reduce the number of members, thus also improving workability in installation of the sleeve cover 37.

Here, by sliding the sleeve cover 37 in the width direction of the ear-cutting blade 33 (horizontal direction in FIG. 14), it is possible to engage the positioning pins 53*a* and 53*b* with the pin holes 57*a* and 57*b*, engage the first positioning bosses 55*a* and 55*b* with the first positioning holes 51*a* and 51*b*, and engage the second positioning boss 55*c* with the second positioning hole 51*c*.

However, for sliding the sleeve cover 37 in the width direction, it becomes necessary to form the clearance holes 60*a* to 60*c* for the blade fixing screws 36 on the opposite surface 37*d* of the sleeve cover 37. Accordingly, it is not possible to form the opposite surface 37*d* into a flat surface, so that the distance L between the opposite surface 37*d* and the edge 33*a* is not constant in the longitudinal direction of the sleeve cover 37. As a result, there is a possibility of being unable to uniformly collect the toner that has accumulated in the vicinity of the edge 33*a* of the ear-cutting blade 33.

In addition, with a configuration in which the clearance holes 60*a* to 60*c* are engaged with the blade fixing screws 36 such that the clearance holes cover the blade fixing screws 36, it is possible to slide the sleeve cover 37 in the width direction on the opposite surface 37*d* formed as a flat surface. However, in this case, the ear-cutting blade 33 needs to have a sufficient width (blade width) for sliding the sleeve cover 37 in the width direction. Thus, this is not preferable in terms of smaller size and compactness of the development device 3*a* because securing the blade width involves an increase in size of the development device 3*a*. Thus, as described in the present embodiment, the configuration should preferably be such that the guide hole 67, the first positioning hole 51*a*, and the first positioning hole 51*b* are formed parallel to the longitudinal direction of the sleeve cover 37 and the ear-cutting blade 33, and the positioning is performed by sliding the sleeve cover 37 in the longitudinal direction of the ear-cutting blade 33.

Additionally, the present disclosure is not limited to each of the embodiments as described above, and various modifications are possible without departing from the scope of the present disclosure. For example, the shape and configuration of the sleeve cover 37 and the film member 40 as shown in each of the embodiments above are mere examples and are therefore not particularly limited by each of the embodiments above, and these can be appropriately set according to the configuration and so on of the development device 3*a*.

For example, in each of the embodiments above, a locking hole 40*a* to which the coil spring 43 is connected is provided at one end of the film member 40, and a notch 40*b* to be engaged with the guide 37*c* is provided at the other end of the film member 40. However, the locking holes 40*a* may be provided on both ends of the film member 40, and the coil spring 43 may be connected to each locking hole 40*a*. In addition, each of the embodiments above assumes a configuration in which the protruding piece 40*c* in the film member 40 is caused to vibrate using the projection 41*b* provided in the idler gear 41. However, it is also possible to vibrate the protruding piece 40*c* in the film member 40 using another gear included in a drive gear row in the toner supply roller 30 or in a drive gear row in the development roller 31.

In addition, in each of the embodiments above, the present disclosure has been applied to the developing devices 3*a* to 3*d*, which use a two component developer, form a magnetic brush on the toner supply roller 30, move only the toner from the toner supply roller 30 to the development roller 31, and supply the toner from the development roller 31 to the photosensitive drums 1*a* to 1*d*.

Figure 19:
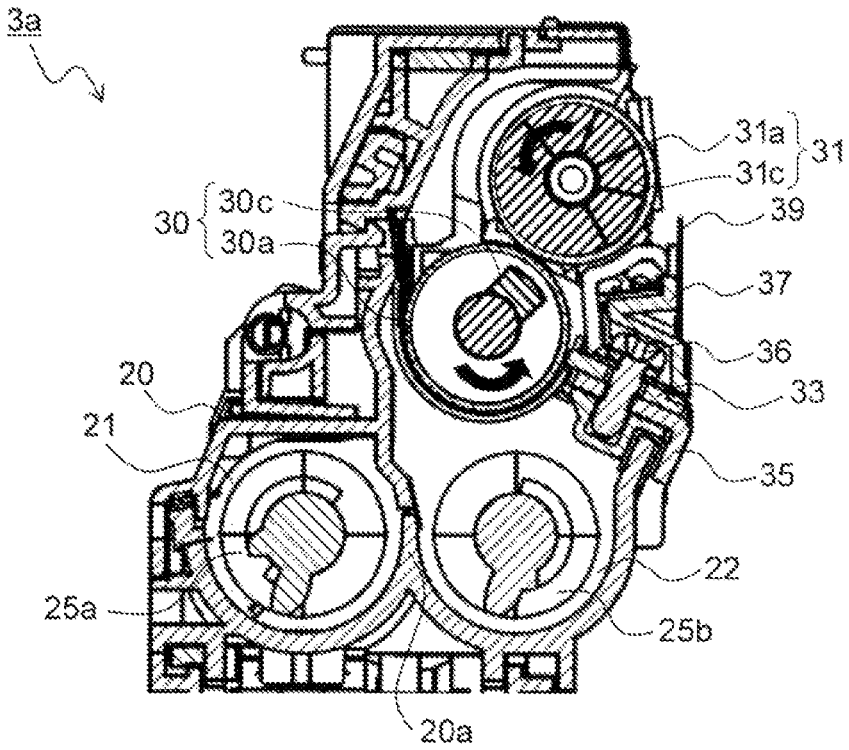
FIG. 19 is a side cross-sectional view showing s development device 3*a* according to the present disclosure, in which configurations of the toner supply roller 30 and the development roller 31 are reversal to those in FIG. 3.

However, other than these, as shown in FIG. 19, the internal configuration of the development roller 31 and the internal configuration of the toner supply roller 30 may be reversal to those in each of the embodiments above.

In other words, the development roller 31 includes a development sleeve 31*a* and a fixed magnetic member 31*c*. The fixed magnetic member 31*c* is included in the development sleeve 31*a* and has a plurality of magnetic poles (corresponding to a plurality of magnetic poles 29 in FIG. 13). Thus, the development roller 31 is a magnetic roller having the same configuration as the toner supply roller 30 in each of the embodiments above. In other words, the development roller 31 is a magnetic roller that carries the two component developer by the plurality of magnetic poles provided inside the development roller 31.

The toner supply roller 30 includes a rotation sleeve 30*a* and a toner-supply-roller-side magnetic pole 30*c*. The toner-supply-roller-side magnetic pole 30*c* is fixed inside the toner supply roller 30. The toner-supply-roller-side magnetic pole 30*c* has a polarity opposite to the polarity of the opposing magnetic pole (main pole) in the fixed magnetic member 31*c*. Thus, the toner supply roller 30 has the same configuration as the development roller 31 in each of the embodiments above.

The toner is supplied to the photosensitive drums 1*a* to 1*d* by the magnetic brush including the two component developer held by the surface of the development roller 31. Along with supplying the toner held by the surface of the toner supply roller 30 to the development roller 31, surplus toner on the surface of the development roller 31 is collected using the toner supply roller 30.

The present disclosure is applicable to a development device including the development roller 31 and the toner supply roller 30 as shown in FIG. 19. In this configuration, it is also possible to effectively suppress the accumulation of toner, which has fallen from the development roller 31, in the vicinity of the restricting blade 33 opposing the toner supply roller 30.

In addition, in each of the embodiments above, the color printer 100 of a tandem type has been described as an example, but the present disclosure, other than this, is also applicable to a monochrome copier, a color copier, a digital multifunction peripheral, a monochrome printer, a facsimile machine, and so on.

The present disclosure can be used for a development device (development devices 3*a* to 3*d*) that includes an internal wall (sleeve cover 37) opposing a development roller (development roller 31) between a blade (ear-cutting blade 33) in a casing (developer container 20) and an image carrier (photosensitive drums 1*a* to 1*d*), According to the present disclosure, it is possible to effectively suppress toner accumulation on the internal wall in the development device. In addition, in an image forming apparatus (color printer 100), it is possible to effectively prevent an image defect due to toner drop resulting from the toner accumulation by including the development device as described above.

According to the present disclosure, by reversing the rotation of the toner supply roller (toner supply roller 30) when image formation is not performed, an idler gear (idler gear 41) included in a drive gear row in the toner supply roller is positioned at a second position, and a projection (projection 41*b*) provided in the idler gear causes a film member (film member 40) to vibrate like a string of a stringed instrument. Accordingly, the toner that has accumulated on the film member is effectively shaken off and falls into a gap between the toner supply roller and the internal wall (sleeve cover 37). As a result, it is possible to effectively suppress toner accumulation in the vicinity of the blade (ear-cutting blade 33) in the casing (developer container 20).

In addition, by reversing the rotation of the toner supply roller (toner supply roller 30), the toner, which has fallen into the gap between the toner supply roller and the internal wall (sleeve cover 37) and has accumulated on a tip of the blade (ear-cutting blade 33), is collected by a magnetic brush formed on a surface of the toner supply roller. The toner thus collected passes through a gap between the toner supply roller and the blade along with the reverse rotation of the toner supply roller, and is forcibly returned into the casing (developer container 20). Furthermore, during image formation, the film member (film member 40) is not caused to vibrate as a result of positioning the idler gear (idler gear 41) at a first position, thus making it less likely that the toner that has accumulated on the film member is shaken off and fall onto the toner supply roller when image formation is performed.

What is claimed is:

1. A development device including: a development roller that is disposed opposite to an image carrier on which an electrostatic latent image is formed and that supplies toner to the image carrier in an area opposing the image carrier; a toner supply roller that is disposed opposite to the development roller and supplies toner to the development roller in an area opposing the development roller; a restricting blade disposed opposite to the toner supply roller at a first predetermined distance; and a casing that houses the development roller, the toner supply roller, and the restricting blade, wherein the casing includes an internal wall opposing the development roller between the restricting blade and the image carrier, the development device comprising:

a film member disposed at a second predetermined distance from a top surface of the internal wall, the film member having flexibility and capable of vibrating in a direction in which the film member moves closer to or apart from the internal wall;

a biasing member that is connected to at least one end in a longitudinal direction of the film member and provides tension to the film member; and an idler gear that is a helical gear, wherein the idler gear includes at least one projection, the idler gear is reciprocally movable along a rotational axis of the idler gear between a first position and a second position, the first position is a position where the projection is apart from an end edge of the film member in response to a rotation of the toner supply roller when image formation is performed, the second position is a position where the projection overlaps with the end edge of the film member in response to a reverse rotation of the toner supply roller when image formation is not performed, and the projection causes the film member to vibrate by intermittently coming into contact with the end edge of the film member along with the rotation of the idler gear positioned at the second position.

2. The development device according to claim 1, wherein the casing includes a sleeve cover that forms the internal wall, the development device further comprising a positioning mechanism that positions the sleeve cover with respect to the restricting blade such that a distance between an opposite surface of the sleeve cover and a tip of the restricting blade is constant, the opposite surface opposing the toner supply roller.

3. The development device according to claim 2, wherein the positioning mechanism includes:

a plurality of positioning pins formed on a top surface of the restricting blade; and a plurality of pin holes formed on a contact surface of the sleeve cover, the plurality of pin holes corresponding to the plurality of positioning pins, and the contact surface having contact with the top surface of the restricting blade, each of the plurality of positioning pins includes:

a shank provided on the top surface of the restricting blade in a projecting manner; and a head formed on a tip of the shank and having a diameter greater than a diameter of the shank, and each of the plurality of pin holes includes:

an engagement hole having an inner diameter greater than the diameter of the head; and a guide hole communicated with the engagement hole and having a shape of an elongated hole, the guide hole having a width that is smaller than the diameter of the head and is greater than the diameter of the shank.

4. The development device according to claim 3, wherein the guide hole is extended almost parallel to a longitudinal direction of the sleeve cover.

5. The development device according to claim 4, wherein the positioning mechanism further includes:

a first positioning boss formed on the contact surface of the sleeve cover, the contact surface having contact with the restricting blade; and a first positioning hole formed on the top surface of the restricting blade and having a shape of an elongated hole that is parallel to the guide hole, the first positioning hole being formed corresponding to the first positioning boss.

6. The development device according to claim 5, wherein the positioning mechanism further includes:

a second positioning boss formed on the contact surface of the sleeve cover, the contact surface having contact with the restricting blade; and a second positioning hole formed on the top surface of the restricting blade and having a same shape as the second positioning boss, the second positioning hole being formed corresponding to the second positioning boss.

7. The development device according to claim 6, wherein when the sleeve cover is slid to a position where the positioning pin becomes engaged with the guide hole, an engagement between the second positioning boss and the second positioning hole restricts a movement of the sleeve cover in a longitudinal direction with respect to the restricting blade.

8. The development device according to claim 3, wherein a movement of the sleeve cover in a vertical direction with respect to the restricting blade is restricted by engaging the positioning pin with the engagement hole and sliding the sleeve cover to a point where the positioning pin becomes engaged with the guide hole.

9. The development device according to claim 5, wherein an engagement between the first positioning boss and the first positioning hole allows a movement of the sleeve cover in a longitudinal direction with respect to the restricting blade, and restricts a movement of the sleeve cover in a width direction with respect to the restricting blade.

10. The development device according to claim 1, wherein the idler gear is positioned, when image formation is performed, at the first position by rotating the toner supply roller, and the idler gear is positioned, when image formation is not performed, at the second position by rotating the toner supply roller in a direction opposite to the direction in performing image formation.

11. The development device according to claim 1, further comprising:

a first drive input gear for providing an input of rotation drive force to the toner supply roller; and a second drive input gear for providing an input of rotation drive force to the development roller, wherein the idler gear is engaged with the first drive input gear and the second drive input gear.

12. The development device according to claim 1, wherein the idler gear includes a plurality of gear teeth, and an amount of movement of the idler gear along the rotational axis when image formation is not performed is adjusted by a tilt of the gear teeth and an amount of rotation of the idler gear when image formation is not performed.

13. The development device according to claim 1, wherein the number of the at least one projection is set, according to a rotation speed and/or a rotation time of the toner supply roller and the development roller when image formation is not performed.

14. The development device according to claim 1, wherein the film member is formed of a material having a toner adhesion weaker than a toner adhesion of the internal wall.

15. The development device according to claim 1, wherein the toner supply roller is a magnetic roller that carries a two component developer by a plurality of magnetic poles provided inside the toner supply roller, and the two component developer includes toner and a carrier.

16. The development device according to claim 1, wherein the development roller is a magnetic roller that carries a two component developer by a plurality of magnetic poles provided inside the development roller, and the two component developer includes toner and a carrier.

17. An image forming apparatus including the development device according to claim 1.

* * * * *